US007394997B2

(12) United States Patent
Mei et al.

(10) Patent No.: US 7,394,997 B2
(45) Date of Patent: Jul. 1, 2008

(54) ANTI-COUNTERFEITING IDENTIFICATION SYSTEM AND METHOD FOR CONSUMABLES

(75) Inventors: Ping Mei, Palo Alto, CA (US); Warren Jackson, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 305 days.

(21) Appl. No.: 11/169,083

(22) Filed: Jun. 28, 2005

(65) Prior Publication Data

US 2006/0291872 A1 Dec. 28, 2006

(51) Int. Cl.
*G03G 15/00* (2006.01)

(52) U.S. Cl. ..... 399/12; 399/252

(58) Field of Classification Search ..... 399/12, 399/252

See application file for complete search history.

(56) References Cited

U.S. PATENT DOCUMENTS 4,767,205 A * 8/1988 Schwartz et al.
5,289,547 A * 2/1994 Ligas et al.
6,501,825 B2 12/2002 Kaiser et al.
6,610,351 B2 8/2003 Shchegolikhim et al.
6,612,494 B1 * 9/2003 Outwater
7,041,362 B2 * 5/2006 Barbera-Guillem
7,065,304 B2 * 6/2006 Taguchi ..... 399/12
2006/0234018 A1 * 10/2006 Nagashima et al.
2006/0293409 A1 * 12/2006 Sanchez et al.

* cited by examiner

*Primary Examiner*—Susan S Lee

(57) ABSTRACT

Provided is an article of manufacturer with anti-counterfeit properties a consumable, having taggant nanoparticles dispersed within it. Each taggant nanoparticle has at least one known physical characteristic such as, the taggant nanoparticles being a predetermined combination of nanoparticles providing at least two different taggant physical characteristics as a taggant code encoding product identification for the consumable so as to permit identification of the consumable. The physical characteristics in an embodiment include a combination of fluorescence, particle size, shape, and/or magnetic properties.

22 Claims, 7 Drawing Sheets

ANTI-COUNTERFEITING IDENTIFICATION SYSTEM AND METHOD FOR CONSUMABLES

FIELD

The present document pertains to the field of tagging and identifying consumable supplies. Embodiments include tagging and automatic recognition of tags indicating validity of origin and specifications of consumable printer supplies such as ink and ink cartridges.

BACKGROUND

Many machines require replenishment or replacement of consumable supplies. Printers require ink or toner and paper. Removable media drives, such as DVD-R drives, require media for use. Automobiles require fuel and oil. Coffemakers require coffee, just as breadmakers require flour. The lifetime cost of a machine reflects not just the cost to build the machine, but the cost of consumable supplies (consumables) needed to operate the machine over its lifetime.

Consumers are often more influenced by initial purchase price than by lifetime cost of goods. As a result, many machines are sold at, or even below, cost; the machine manufacturer hoping to make up the deficit and turn a profit from later sales of the consumables required to keep the machine running.

Freeloading manufacturers may recognize that the profit is in consumables, and undercut the machine manufacturer's price for them; if consumers buy from freeloaders, the machine manufacturer must raise prices on machines to stay in business. If a customer agrees to buy consumables from a machine manufacturer, in return for a low initial purchase price, it is desirable to enforce the contract automatically.

Some manufacturers produce and sell goods at a low price for use in one country, while selling the same or similar goods at a higher price for use in another country. A grey market often exists whereby merchants buy the goods in low-priced countries and resell them in high-priced countries. It can be desirable to restrain the grey market.

Some machines must be adjusted for optimum performance with different lots, or manufacturers, of consumables. For example, consider color printers. If a batch of ink cartridges has a more intense magenta ink than prior cartridges, photographs printed using those ink cartridges will have unrealistic color unless the printer is adjusted to compensate for the over-intense magenta ink by slightly reducing the amount of magenta ink applied to pixels of the photographs. A slight reduction in magenta ink can be achieved by slightly shortening inkjet pulsewidths, however this can only happen automatically if lot-dependent ink density information is conveyed to the printer.

Prior Taggants

Small amounts of identifiable materials, known as taggants, can be added to commodities to allow those commodities to be identified. These taggants can be used to identify a manufacturer, a lot, or a type of a commodity.

U.S. Pat. No. 6,501,825, "Methods for identification and verification", describes use of x-ray fluorescent taggants to label substances; its background section describes addition of ultraviolet and infrared fluorescent taggants to substances for identification.

U.S. Pat. No. 6,610,351 describes use of Raman scattering to measure particle sizes of particulate taggants.

Serial Numbers

Many items, from automobiles through drugs to printer ink cartridges and currency, have serial and/or lot numbers attached. For purposes of this document, the term serial number includes lot numbers.

Serial numbers often encode information beyond sequence of manufacture. For example, a typical automobile VIN number encodes vehicle model, model year, engine size, and place of manufacture in addition to production sequence. Drug lot numbers may encode drug type and expiration date as well as place and sequence of manufacture. DVD disk player serial numbers may encode information regarding regions of the world in which the player is to be sold, and which DVD disks the player is permitted to play. Software serial numbers often incorporate encrypted enabling information for a program.

It can therefore be desirable to restrict use of perishable goods, such as drug ingredients, to use with their original cartridges such that expiration dates can be enforced. It can be desirable to detect counterfeit consumables, or consumables manufactured for use elsewhere in the world. It can also be desirable to lock particular lots of consumables to use on particular models and types of machines.

SUMMARY

This invention provides an article of manufacturer with anti-counterfeit properties. In particular, and by way of example only, according to an embodiment, provided is an article of manufacturer with anti-counterfeit properties including: a consumable; a plurality of taggant nanoparticles dispersed within the consumable, each taggant nanoparticle having at least one known physical characteristic; wherein the plurality of taggant nanoparticles comprise a predetermined combination of nanoparticles providing at least two different taggant physical characteristics of at least two different categories as a taggant code encoding product identification for the consumable so as to permit identification of the consumable.

DETAILED DESCRIPTION

Before proceeding with the detailed description, it is to be appreciated that the present teaching is by way of example, not by limitation. The concepts herein are not limited to use or application with a specific type of consumable or method and apparatus for tagging and automatically verifying consumables. Thus, although the instrumentalities described herein are for the convenience of explanation, shown and described with respect to exemplary embodiments, it will be appreciated that the principals herein may be equally applied in other types of method and apparatus for tagging and verifying consumable as non counterfeit.

Figure 1:
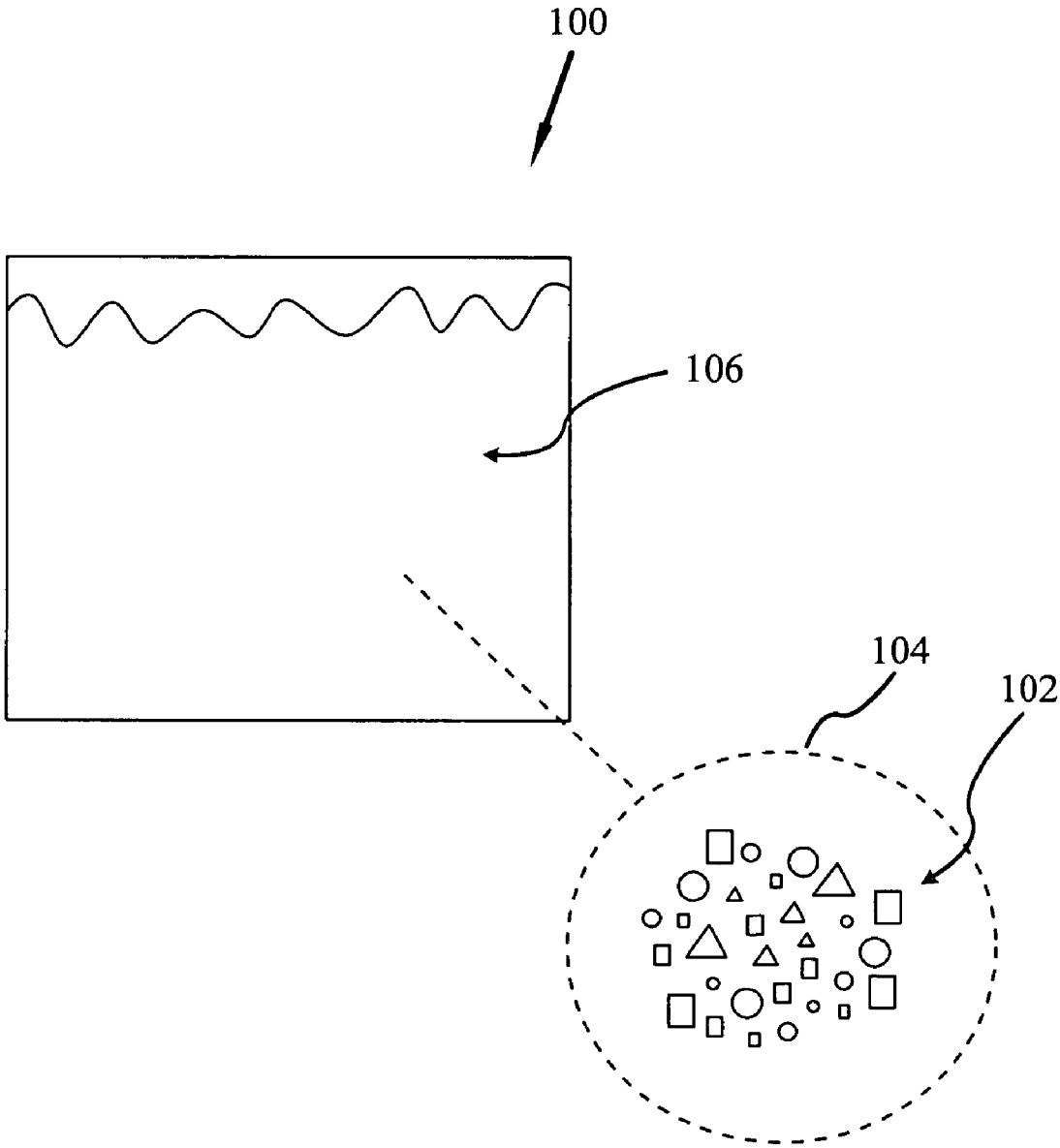
FIG. 1 is a conceptual illustration of an article of manufacturer with anti-counterfeiting properties in accordance with an embodiment.

Referring now to the drawings, and more specifically to FIG. 1, there is shown an article of manufacturer with anti-counterfeiting properties 100. Specifically a plurality of taggants 102 (shown in enlarged area 104) are dispersed within a consumable 106, each taggant 102 having at least one known and measurable physical characteristic. A predetermined combination of taggants 102 providing at least two different physical characteristics provide a taggant code encoding product identification for the consumable 106.

In at least one embodiment the plurality of taggants 102 are taggant nanoparticles. In at least one alternative embodiment the plurality of taggants 102 are taggant dyes. The physical characteristics of the taggants 102 include, but are not limited to, taggant-specific characteristics of categories selected from size, shape, infrared fluorescence, ultraviolet fluorescence, reflectance and magnetic properties of the taggants.

Collectively, the plurality of recognizable taggants form a lexicon of possible taggants. Each taggant of the lexicon is recognizable by the taggant-specific characteristics of the above categories. Taggant-specific characteristics may include specific fluorescent spectral characteristics, particular particle sizes, or other characteristics. Taggants of the lexicon are assigned weights or meanings for use in taggant codes. These measurable physical characteristics may include one or more of particle size, particle shape, infrared fluorescence, ultraviolet fluorescence, or magnetic properties for each taggant; for example a taggant may be round one-micron diameter particles incorporating a particular infrared fluorescent dye and a particular ultraviolet fluorescent dye.

Information conveyed in the taggant code is encoded by presence or absence of particular taggants of the lexicon, and may also be encoded by relative concentrations of particular taggants. Each consumable need only have a subset of lexicon members present. For example, in an embodiment having six ultraviolet-fluorescent taggants in the lexicon, tagged consumables may have as few as two taggants present.

In order to render counterfeiting of supplies difficult, taggants used in each consumable include taggants selected from the lexicon such that at least one taggant has a measurable physical characteristic of a first category, and at least one taggant (which may be the same taggant) has a measurable characteristic of a second category. For example, in an embodiment employing infrared and ultraviolet fluorescent dye taggants, the consumable includes both one or more infrared fluorescent dyes and one or more ultraviolet fluorescent dye. In another example, an embodiment may use taggants having measurable characteristics of both ultraviolet fluorescent and particle size categories, the consumable may then contain taggant particles of particular diameters each incorporating particular ultraviolet fluorescent dyes.

For ease of discussion and illustration, the taggants 102 are shown in FIG. 1 as triangles, rectangles and circles in three different sizes. As is further discussed below, when a predetermined combination of taggants 102 representing product information for the article of manufacture are mixed with the consumable 106 to provide a taggant code based on taggant physical properties of at least two different taggant physical categories, the article of manufacturer becomes self identifying. Counterfeit consumables may thus be distinguished from legitimate consumables.

Figure 2:
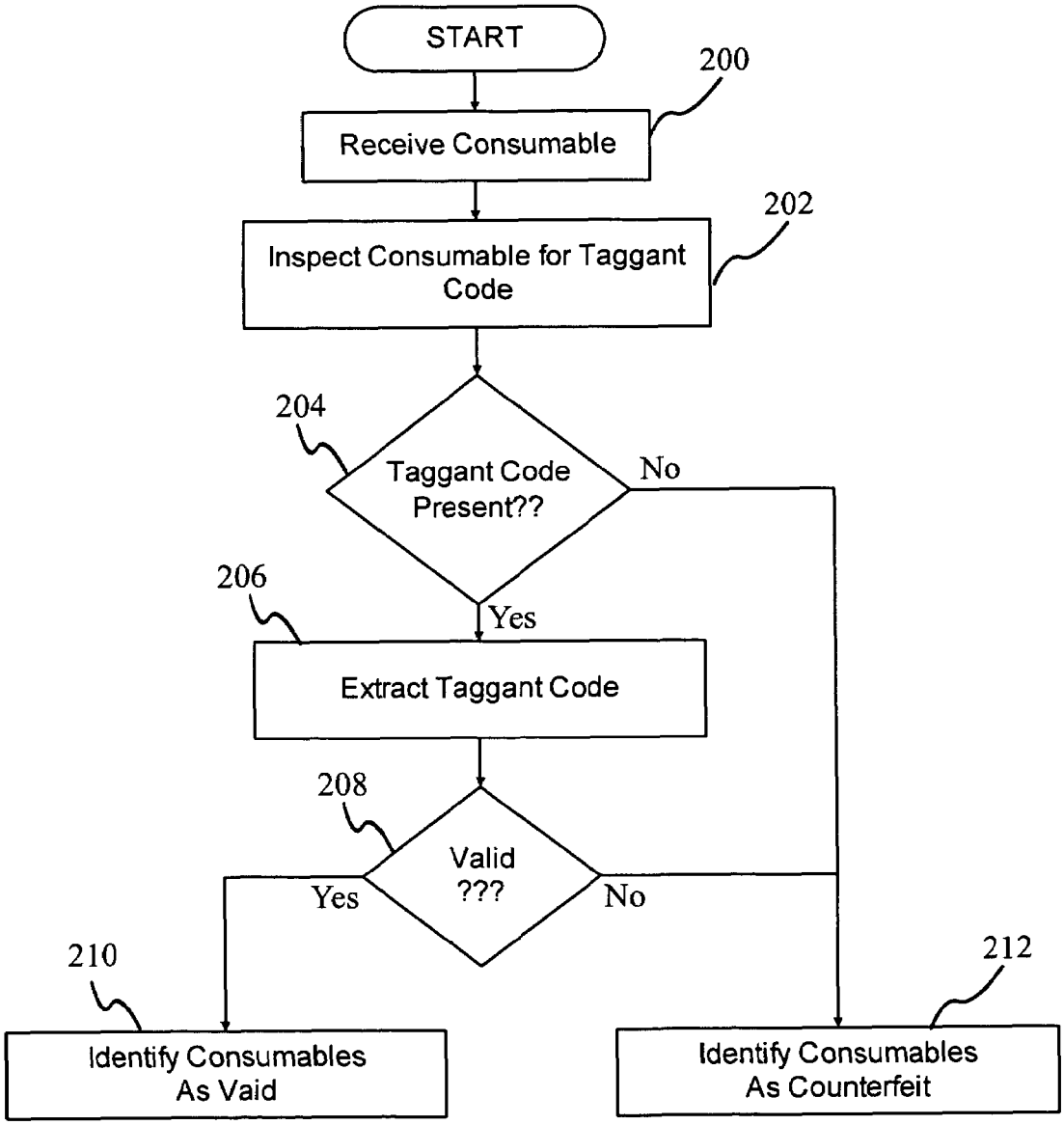
FIG. 2 is a high level flowchart of a method of detecting the anti-counterfeit information in a consumable supply in accordance with an embodiment.

Such a determination of non-counterfeit status may be generally summarized as shown in FIG. 2. A consumable supply including a plurality of taggants is received, 200. Each taggant has a known physical characteristic, and the plurality of taggants establishes a taggant code based on at least two different taggent physical characteristics. The consumable is inspected for the taggant code, 202.

If no taggant code is found, decision 204, the consumable are identified as counterfeit 212. If the taggant code is found, decision 204, the taggant code is extracted 206 by observing the physical characteristics of the taggants. The extracted code is then evaluated, 208. If the code is valid, the consumables are identified as valid, i.e. non-counterfeit, 210. If the code is invalid, the consumables are identified as counterfeit, 212. The extracted taggant code thus permits identification of the consumable supplies as non-counterfeit. More detailed methods for encoding and detecting anti-counterfeit information in consumable supplies are set forth below.

Figure 3:
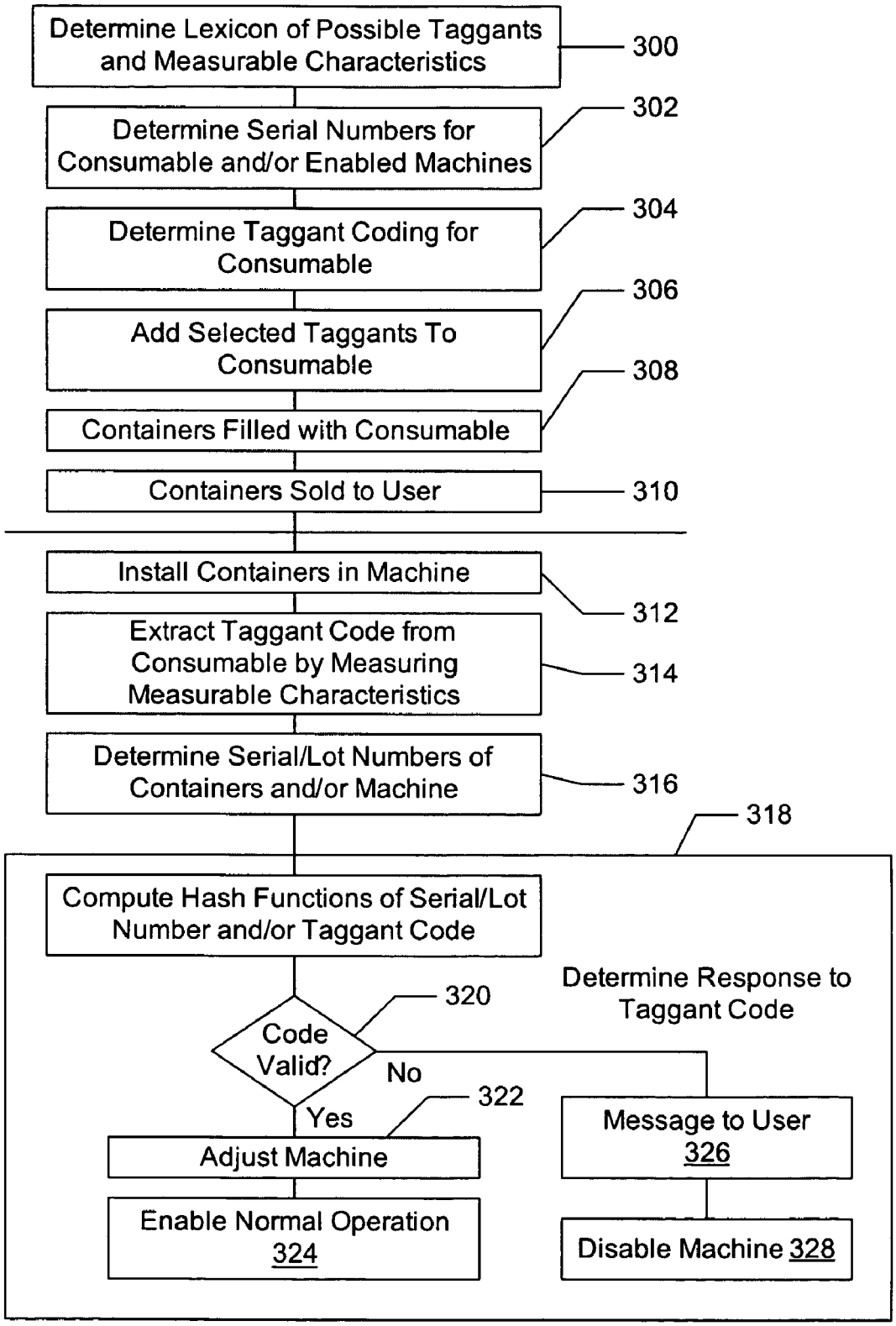
FIG. 3 is an abbreviated flowchart of a method for tagging and automatically verification of consumable supplies for a machine.

A method for detecting counterfeit consumable supplies is illustrated in FIG. 3. A party, such as a manufacturer, first determines 300 a lexicon of possible taggants for use with the method. The taggants are chosen such that each taggant has at least one measurable physical characteristic that is readily measurable and distinguishable from background characteristics of the supplies. In embodiments, these measurable characteristics may include infrared or ultraviolet fluorescence, particular sizes and shapes of particulate taggants, magnetic properties and or combinations thereof.

A product identification number (e.g. "product ID") for consumable containers and machines with which the consumable is permitted to operate are determined 302. In an embodiment, the consumable container product ID code incorporates a lot number, a serial number, an expiration date, a family of compatible machines, and or other information. The product ID may also include a sequence number of manufacture. In addition, in at least one embodiment, the product ID may be publicly known and available, whereas in an alternative embodiment the product ID may be kept secret.

Taggant coding for the consumable is determined 304. More specifically, a pre-determined combination of taggants is selectively mixed with the consumable. In a hashed-serial embodiment, the tagging coding is determined by executing a hash function on a field of the product ID to provide a hash value. In a hashed-taggant embodiment, the consumable container product ID code includes a field derived by executing a hash function on a number derived from a determined taggant coding. In a typical embodiment, the particular hash function used is kept secret.

For purposes of this document, hash functions are functions that map an input number having a large range to an output number having an equal or smaller range. Hash functions typically scatter clusters of sequential input numbers throughout the output number range. For example, a hash function may include such manipulations as splitting the first number into a first and second smaller number according to bit positions in the number, adding a cipher key to each smaller number, then multiplying the first by the second smaller number, then extracting a field of bits from the middle bits of the product. Many hash functions, especially those having output number ranges smaller than the input number range, are one-way functions. One-way functions include functions having the property that is not always possible to determine the original value of each input from the output value, often because several possible input values map to each possible output value. Many other hash functions executable on a microcontroller are possible.

Taggants corresponding to the taggant coding are selected and added 306 to the consumable. The consumable containers are filled 308 with the consumable, and marked with their assigned container product ID codes. The containers are the sold 310 to users.

When the user installs 312 the containers in the machine that uses the consumable, the machine inspects the consumable supply for the taggant code. More specifically, the machine extracts 314 the taggant code (if present) from the consumable by measuring measurable characteristics of the taggants and applying appropriate weights to each taggant's presence, absence, concentration, or scattering.

The machine then determines 316 its own product ID and the product ID of the consumable container. It then uses part or all of either product ID, and the taggant code, to determine 318 a response to the taggant code extracted from the consumable.

In the hashed-taggant embodiment, the machine applies the same hash function to the extracted taggant code as was used in determining 302 the product ID for the consumable, and compares the result to a portion of the product ID to determine 318 a response to the extracted taggant code.

In the hashed-serial embodiment, the machine applies the same hash function as was used in determining 304 the taggant code to the product IDs and compares the result to the extracted taggant code to determine 318 a response to the taggant code.

In both hashed-taggant and hashed-serial embodiments, if the taggant code is valid 320, the machine may optionally be adjusted 322 according to information embodied either in the taggant code or container product ID, and machine operation is enabled 324. If the taggant code is not valid 320, a message is given to the user 326, and operation of the machine may be disabled 328. Moreover, if the taggant code is not valid or not present, the consumable is presumed to be counterfeit.

Figure 4:
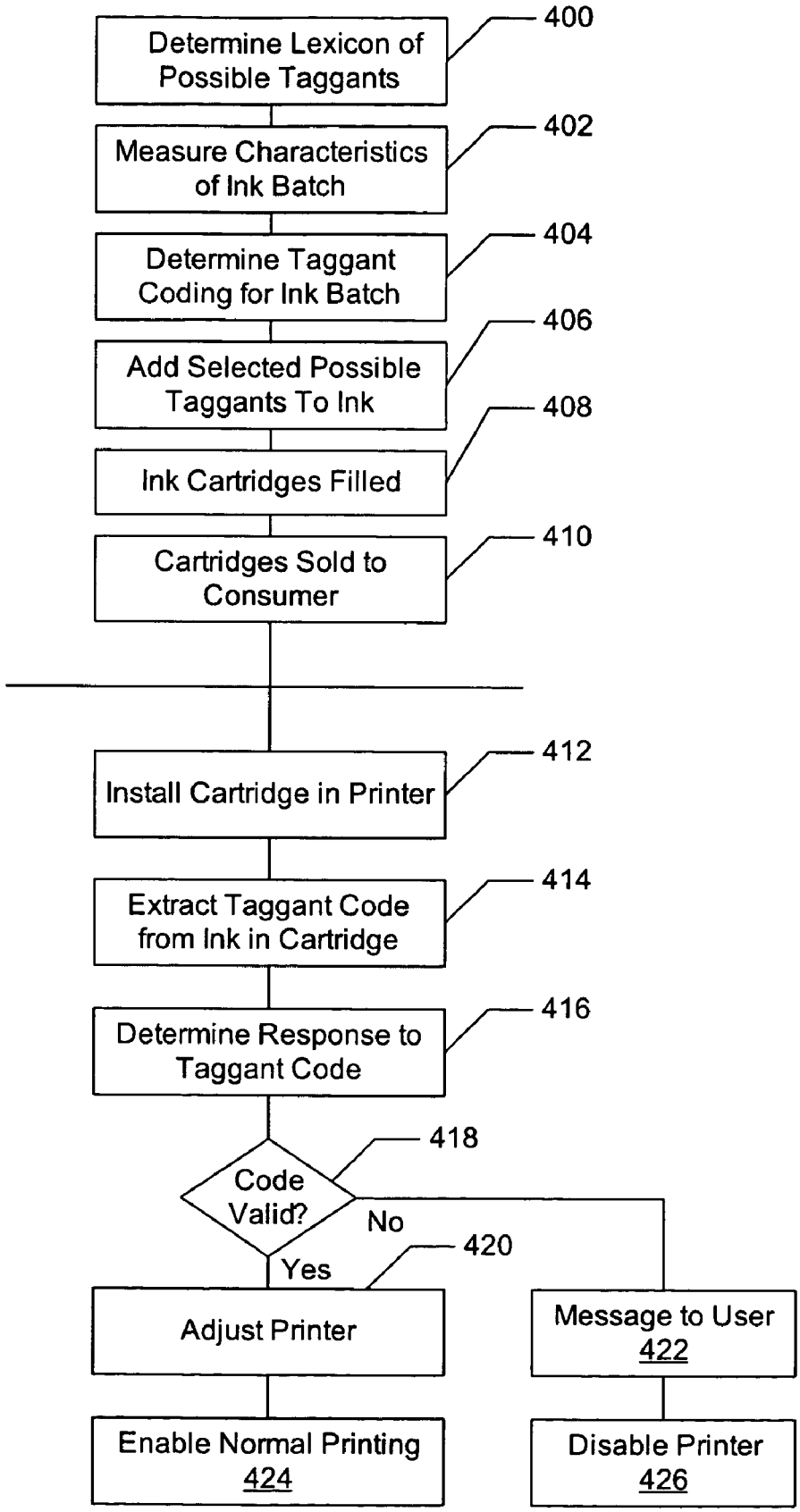
FIG. 4 is an abbreviated flowchart of a method for tagging and automatically identifying consumable printer ink.

A system for tagging and automatically identifying consumable printer ink is illustrated in FIG. 4. For the purposes of this discussion the term "ink" is generally understood and appreciated to include toner materials as well. Initially, a lexicon of possible taggants is determined 400. At the cartridge factory, a batch of ink is prepared 402. Relevant characteristics of the ink are measured. Information selected from particular characteristics of the ink, product identifications of enabled machines, and product identification of the ink, are used to determine 404 a selection, or taggant code, of taggants from a lexicon of possible taggants. The selected taggants are then added 406 to the ink. Once the taggants are added and blended into the ink, ink cartridges are filled 408 with the ink. Filled ink cartridges are then sold 410 to consumers.

Figure 5:
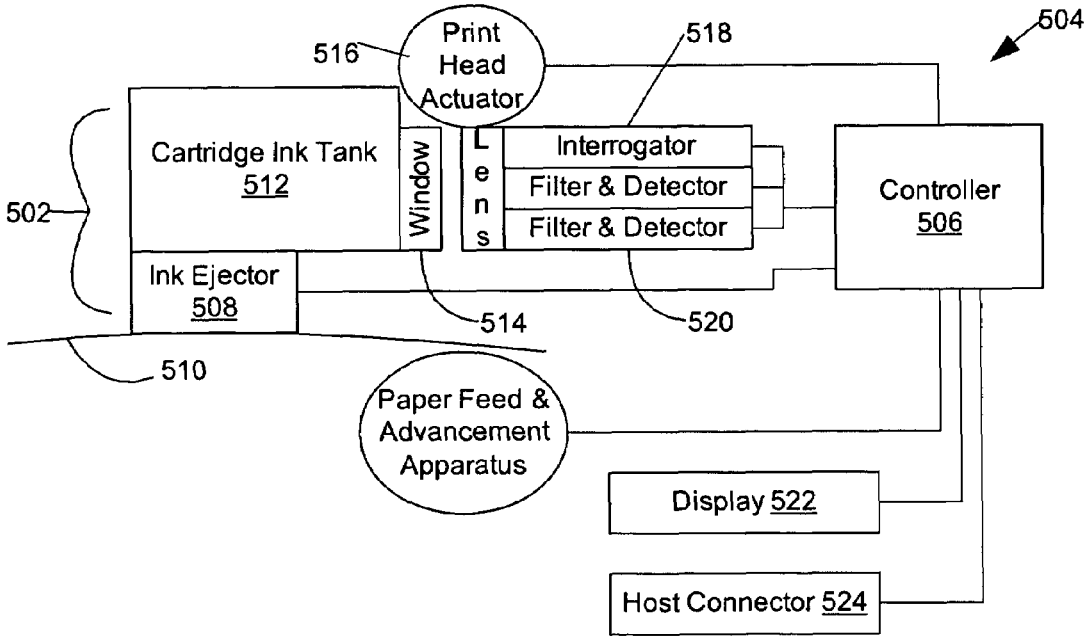
FIG. 5 is a block diagram of an inkjet printer capable of recognizing fluorescent-tagged printer ink.

With reference to FIG. 5 as well as FIG. 4, an ink cartridge 502 is installed 412 in a printer 504. The printer has a controller 506 that connects to the ink ejector 508 of the ink cartridge to control placement of ink on paper 510. Ink cartridge 502 also has an ink cartridge or ink tank 512 which was previously filled 408 with the tagged ink. Ink tank 512 has a clear or translucent window 514.

The printer controller 506 has attached to it a taggant identification apparatus. Taggant identification apparatus has an interrogator 518 arranged to shine preselected particular wavelengths of light on the window 514 when the ink cartridge is in a predetermined interrogation position in the printer carriage. Light from the interrogator 518 enters window 514, and excites any fluorescent taggants present in the cartridge ink tank 512 to glow. Each taggant on the lexicon of available taggants glows at one or more separate taggant-specific wavelengths when illuminated by the interrogation lamp.

Light from the glowing taggants exits window 514 and enters filter and detector 520 assemblies of the taggant identification apparatus. In a particular embodiment, the filter and detector assemblies each incorporate a filter specific for passing light emitted by one taggant of the lexicon of available taggants, and a photodetector. Only those filter and detector assemblies corresponding to a particular taggant of the lexicon of taggants that is present in the ink tank 512 will detect light from the glowing taggants, therefore signals from the filter and detector assemblies correspond to the taggant code. In one embodiment, ink tank 512 is part of a cartridge for an inkjet printer, in another embodiment ink tank 512 contains electrophoretic ink, in another embodiment ink tank 512 is a toner reservoir containing a dry powder toner.

Figure 6:
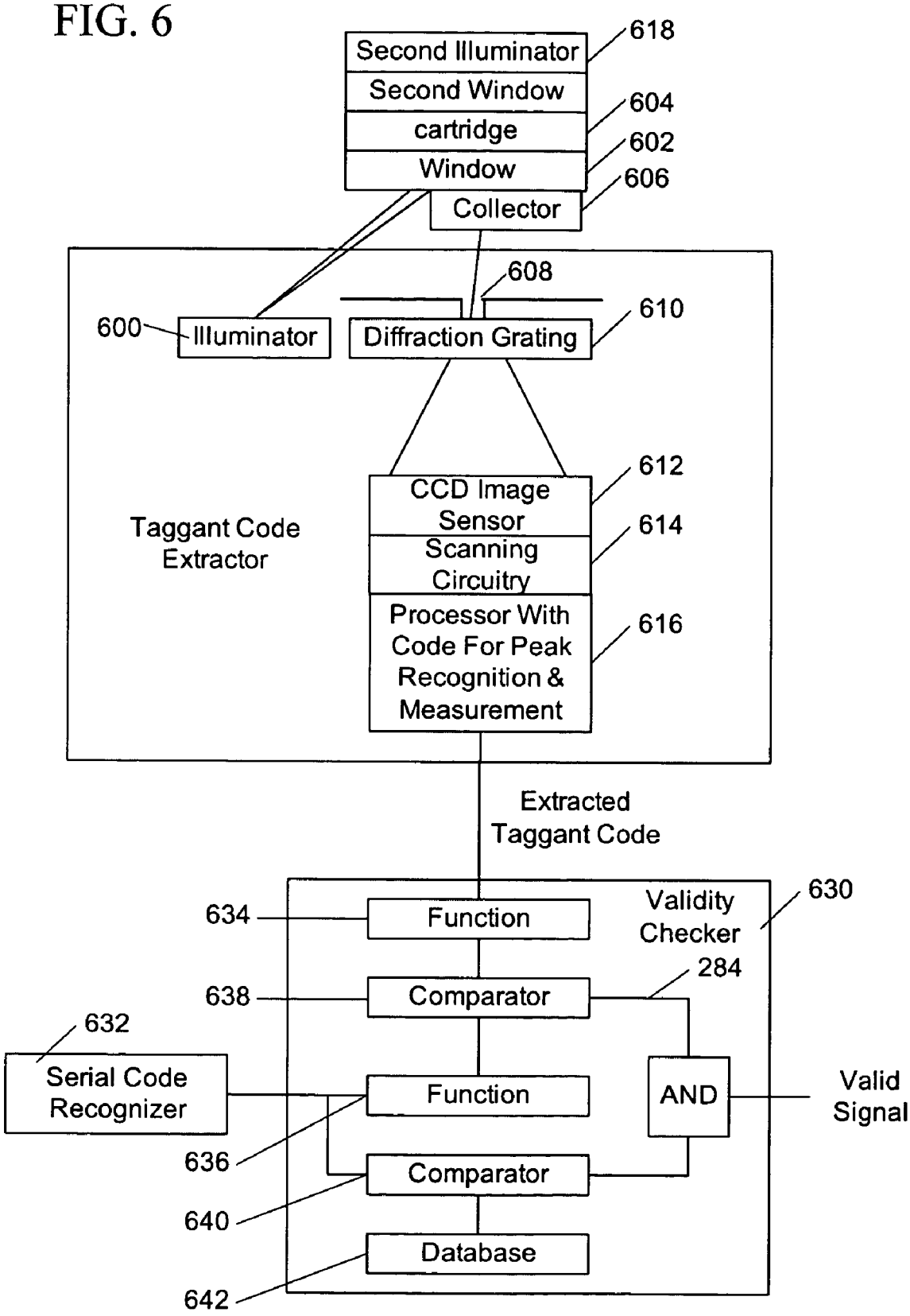
FIG. 6 is a block diagram of an alternative spectrographic taggant recognition apparatus

In an alternative spectrographic embodiment of the taggant identification system, as illustrated in FIG. 6, light from an interrogator 600 enters window 602 of the ink tank, also referred to as an ink cartridge 604. Light from excited fluorescent taggants in cartridge 604 exits window 602, is collected by fiber optic collector 606, passes through spectrometer slit 608, and enters a diffraction grating 610 that separates it into its component wavelengths. Light from the diffraction grating 610 impinges upon an integrated CCD image sensor 612, having a rectangular array of charge-coupled-device (CCD) photodetectors as is known in the arts of scanners and video cameras. The CCD 612 is read through scanning circuitry 614. Signals from the scanning circuitry 614 are processed by a microprocessor subsystem 616 to recognize and measure spectral peaks in light received through the spectrometer slit 608. These recognized and measured peaks are used to extract the taggant code.

In a second mode of operation, the taggant identification system of FIG. 6 is capable of detecting and measuring light scattered by taggant particles in cartridge 604. In this mode, second interrogator 620 passes light through cartridge (or container) 604. Collector 606 is a fiber optic device that collects light scattered through several angles, and presents light from each angle at a different location along spectrometer slit 608.

Particular embodiments (not shown) may have multiple sets of CCD 612 arrays and diffraction grating 610 or prisms; it is anticipated that an embodiment having taggants of ultraviolet fluorescent and infrared fluorescent categories may have one set of CCD 612 and grating 610 for measuring ultraviolet properties and a second set for measuring infrared properties.

Signals indicative of taggants present in the ink within ink tank 512 are transmitted from the filter and detector assemblies 520, or from a microprocessor system coupled to the filter and detector assemblies 520, to controller 506. Controller 506 extracts 414 the taggant code from the ink in the cartridge by using print head actuator 516 to position the ink cartridge 502 in the interrogation position, activating the interrogator 518 (for example a lamp), and observing signals indicative of activated filter and detector assemblies 520 or identified by microprocessor subsystem 620.

A validity checker 630 (FIG. 6) is implemented in controller 506. Validity checker includes a serial code recognizer 632 for recognizing any product ID on the consumable container or ink tank/cartridge 512 or 604. The validity checker contains code for performing a hash function 634 on the extracted taggant code in the hashed-taggant embodiment, code for performing a hash function 636 on the recognized product ID in the hashed-serial embodiment, and code for comparing 638 to give a valid taggant signal. The validity checker may also contain code 640 for comparing portions of the recognized product ID to a database 642 to determine if the consumable is permitted in the machine.

The controller 506 thereupon determines 416 a response to the taggant code read from the ink cartridge. If 418 the taggant code is valid, the printer is adjusted 420 for optimum operation with the ink and enables printer operation 424. If 418 the taggant code is invalid, the controller 506 displays a message to the user 422 through display device 522; and may, at the printer manufacturer's option, disable 426 the printer until a cartridge having a valid taggant code is installed.

In an alternative embodiment, no display device 522 is present in the printer. Instead of giving a message 422 to the user through display device 522, a message 422 is given to the user by transmitting signals through host connector 524 to any attached host computer, and providing a message on a display device of the host computer.

With dry-toner electrostatic printers, each taggant comprises plastic beads of predetermined size, the plastic beads incorporating a fluorescent tagging dye such as previously described with reference to inks.

The filter and photodetector assemblies, or diffraction grating and CCD sensor apparatus, may be capable of not just detecting which and whether taggants are present, but of determining whether the concentration of taggant present in the ink exceeds various thresholds. This can be of use in detecting adulterated or counterfeit consumables, or in conveying multiple bits per taggant lexicon member. In an embodiment having three taggant-concentration thresholds, two bits of binary information can be conveyed with each taggant of the lexicon, a four-taggant system could convey eight bits of machine-adjustment and hashed-serial-number information.

The method and apparatus are adaptable to implementations having an arbitrary number of taggants. Embodiments having filter and detector assemblies as described are particularly suited to small lexicons of possible taggants, while spectrographic embodiments having large lexicons of possible taggants are capable of conveying many bits of information in the taggant code.

In an embodiment, taggant codes as herein described are used in perfume or drug tablet ingredients to ensure that these ingredients are not counterfeit and are correctly labeled. With this embodiment, associated perfume or drug blending and packaging machines automatically verify taggant codes of liquid, solid, or powder consumable supplies, and are keyed to operate only with supplies having a valid taggant code matching a consumable container product ID code. These machines then use additional information from the container product ID code to verify ingredient identity against a database of acceptable ingredients for the product being manufactured, and disable themselves when given incorrect, expired, or counterfeit ingredients.

In an alternative embodiment, a selection of one or more decoy taggants is added to the consumable supplies. These decoy taggants have properties, such as fluorescence, that resemble properties of taggants of the taggant lexicon; but are measurably distinct, such as in the wavelength of fluorescence, from those taggants actually used in the taggant lexicon. A counterfeiter attempting to duplicate tagged consumables must either duplicate both taggants of the taggant lexicon and decoy taggants, or identify the decoy taggants as decoys.

It is known that the scattering of light by small particles is a function of particle shape, size, and composition.

In an alternative embodiment, the lexicon of possible taggants includes some possible taggants that are pyramidal nanoparticles of an electrically conductive thermoplastic of predetermined sizes near a wavelength of infrared light, of which predetermined lexicon members are doped with one or more ultraviolet-fluorescent dyes. Second taggant particles are spherical particles of assorted sizes near a wavelength of infrared light, predetermined lexicon members of which are doped with one or more ultraviolet-fluorescent dyes. These particles can be distinguished by peak location and peak spectra by the embodiment of FIG. 6.

In an alternative embodiment, the lexicon of possible taggants includes some taggants that are nanoparticles of a variety of predetermined sizes, of which predetermined taggants of the lexicon are doped with one or more fluorescent dyes. These particles can be distinguished by the embodiment of FIG. 6, since particle size affects scattering of the beam produced by second interrogator 620 (e.g. an illuminator such as a lamp).

If a suspension of particles in electrically conductive fluid flows through a passage in an insulating barrier, the effective resistance of the fluid will fluctuate as the particles pass through the passage; the fluctuations in resistance can be used to estimate sizes of the particles. Further, as the particles pass through the passage they tend to align with the flowing fluid. An interrogating light can be focused on suspended particles as they, and their suspending fluid, flows through such a passage, and fluorescence or light scattering of particles can be determined simultaneously with measurement of particle size. This is the basis of flow cytometry, as is often used in biological research to measure cell sizes while detecting adherent fluorescent-labeled antibodies.

Figure 7:
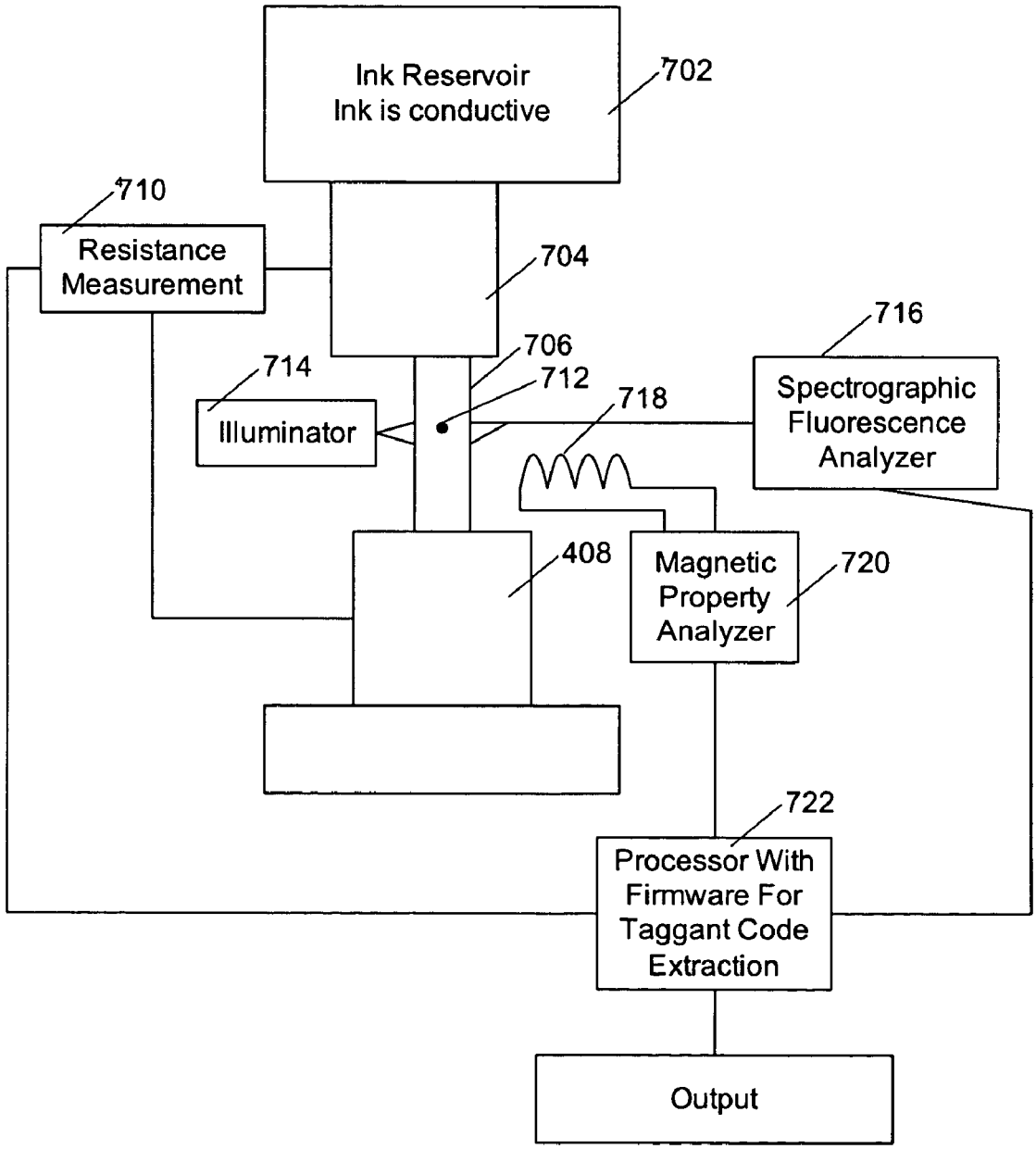
FIG. 7 is a block diagram illustrating simultaneous measurement of two physical properties of a taggant particle.

In another alternative embodiment, as illustrated in FIG. 7, a liquid ink containing suspended taggant particles is drawn from an ink reservoir 702 of an ink cartridge through a first hollow electrode 704 into a transparent capillary tube 706. In an embodiment, a sample of the ink is first automatically diluted with an electrically conductive dilutent, such as salt water, to reduce the rate at which ink pigment and taggant particles flow into the capillary tube 706, such that characteristics of individual taggant particles can be more readily measured. Capillary tube 706 ends in a second hollow electrode 708. Resistance measurement apparatus 710 measures electrical resistance of diluted ink in capillary tube 706. In an alternative embodiment, capillary tube 706 is an etched channel in a printer head component of an ink cartridge. This resistance changes as taggant particles 712 are drawn through tube 706, being increased by electrically resistive particles 712 proportionally to particle diameter and reduced by electrically conductive particles.

An illuminator 714 provides ultraviolet illumination to taggant particles 712 in capillary tube 706, while a spectrographic analyzer 716 measures any fluorescent properties of the taggant particles 712. Magnetic properties of taggant particles 712 in tube 706 are also measured by a sensing coil 718 of a magnetic property analyzer 720. A processor 722 receives signals from resistance measurement apparatus 710, magnetic property analyzer 720, and spectrographic analyzer 716 and executes firmware for taggant code extraction. With this embodiment, taggant nanoparticle physical characteristics such as particle size, magnetic properties, and fluorescence are measured for individual taggant particles. Processor 722 provides taggant code information to other components of the printer.

Since a product identification (ID) code of an item may incorporate multiple types of information, the term field of a product ID code as used herein means a grouping of characters such as letters, numbers, or binary bits from a product ID or lot identification code. A field of a product ID code as used herein may incorporate characters representing one or many types of information that are encoded in the product ID code.

While the forgoing has been particularly shown and described with reference to particular embodiments thereof, it will be understood by those skilled in the art that various other changes in the form and details may be made without departing from the spirit and hereof. It is to be understood that various changes may be made in adapting the description to different embodiments without departing from the broader concepts disclosed herein. The following claims are intended to cover all generic and specific features described herein, as well as all statements of the scope of the present method, system and structure, which, as a matter of language, might be said to fall therebetween.

What is claimed is:

1. An article of manufacture with anti-counterfeit properties comprising:

a consumable;

a plurality of taggant nanoparticles dispersed within the consumable, each taggant nanoparticle having at least one known physical characteristic;

wherein the plurality of taggant nanoparticles comprise a predetermined combination of nanoparticles providing at least two different taggant physical characteristics of at least two different categories as a taggant code encoding product identification for the consumable so as to permit identification of the consumable; and wherein a machine receiving the consumable is enabled upon the determination of the consumable as non-counterfeit as indicated by the taggant code.

2. The article of manufacture with anti-counterfeit properties of claim 1, wherein the known physical characteristics of each taggant are physical characteristics of categories selected from the group consisting of size, shape, ultraviolet fluorescence, infrared fluorescence, magnetic property and combinations thereof.

3. The article of manufacture with anti-counterfeit properties of claim 1, wherein the taggant code encodes a product identification.

4. The article of manufacture with anti-counterfeit properties of claim 3, wherein a product identification is encoded as a hash.

5. The article of manufacture with anti-counterfeit properties of claim 1, further including nanoparticles with decoy taggants.

6. The article of manufacture with anti-counterfeit properties of claim 1, wherein the taggant code is secret.

7. The article of manufacture with anti-counterfeit properties of claim 1, wherein the consumable is selected from the group consisting of ink and toner.

8. A method of encoding anti-counterfeit information in consumable supplies, comprising:

providing plurality of different nanoparticles, each nanoparticle having at least one taggant with at least one known physical characteristic; and selectively mixing a pre-determined combination of nanoparticles with a consumable, the combination of nanoparticles encoding product information as a taggant code, the taggant code employing at least two different taggant physical properties of at least two different categories; and wherein a machine receiving the consumable is enabled upon the determination of the consumable as non-counterfeit as indicated by the taggant code.

9. The method of claim 8, wherein the categories of physical characteristics of each taggant are selected from the group consisting of size, shape, ultraviolet fluorescence, infrared fluorescence, and magnetic property.

10. The method of claim 8, wherein the taggant code encodes a product identification.

11. The method of claim 8, further including nanoparticles with decoy taggants.

12. The method of claim 8, wherein the taggant code is secret.

13. The method of claim 8, wherein the consumable comprises a consumable selected from the group consisting of ink and toner.

14. A method of detecting anti-counterfeit information in consumable supplies, comprising:

receiving a consumable supply, the consumable supply including a plurality of nanoparticles, each nanoparticle having at least one taggant with a known physical characteristic, the plurality of taggants establishing a taggant code based on at least two categories of taggant physical characteristics;

inspecting the consumable supply for the taggant code; and extracting, in response to the taggant code being present, the taggant code by observing the physical characteristics of the taggants;

wherein the extracted taggant code permits identification of the consumable supplies as non-counterfeit; and wherein a machine receiving the consumable is enabled upon the determination of the consumable as non-counterfeit.

15. The method of claim 14, wherein the categories of known physical characteristics of each taggant are selected from the group consisting of size, shape, ultraviolet fluorescence, infrared fluorescence, and magnetic property.

16. The method of claim 14, wherein inspecting the consumable supply for the taggant code includes at least one measurement selected from the group consisting of illuminating the consumable supply and observing light emitted by fluorescence by taggants in the consumable supply, illuminating the consumable supply and observing light scattered by the taggants in the consumable supply, and illuminating the consumable supply and observing light absorbed by the taggants in the consumable supply.

17. The method of claim 14, wherein the machine is a printer and the consumable supply is ink or toner.

18. The method of claim 14, wherein the taggant code is a product identification.

19. An article of manufacturer with anti-counterfeit properties comprising:

a consumable;

a plurality of taggant dyes each having at least one known physical characteristic;

wherein a predetermined combination of taggant dyes provide at least two different taggant physical characteristics to encode product identification for the consumable as a taggant code so as to permit identification of the consumable; and wherein a machine receiving the consumable is enabled upon the determination of the consumable as non-counterfeit.

20. The article of manufacturer with anti-counterfeit properties of claim 19, wherein the physical characteristics of each taggant are characteristics of categories selected from the group consisting of taggant particle size, taggant particle shape, taggant infrared fluorescence, taggant ultraviolet fluorescence, taggant magnetic properties, and combinations thereof.

21. The article of manufacturer with anti-counterfeit properties of claim 20, wherein the taggant code encodes a product identification.

22. The article of manufacturer with anti-counterfeit properties of claim 21, wherein the product identification is encoded as a hash.

* * * * *